US006878181B2

(12) United States Patent
Carpenter

(10) Patent No.: US 6,878,181 B2
(45) Date of Patent: Apr. 12, 2005

(54) CEMENTED CARBIDE FOR OIL AND GAS APPLICATIONS WITH TOUGHNESS FACTOR

(75) Inventor: Michael John Carpenter, Nuneaton (GB)

(73) Assignee: Sandvik AB, Sandviken (SE)

( * ) Notice: Subject to any disclaimer, the term of this patent is extended or adjusted under 35 U.S.C. 154(b) by 19 days.

(21) Appl. No.: 10/691,629

(22) Filed: Oct. 24, 2003

(65) Prior Publication Data

US 2005/0039574 A1 Feb. 24, 2005

(51) Int. Cl.[7] ..... C22C 29/08
(52) U.S. Cl. ..... 75/240; 75/241
(58) Field of Search ..... 75/240, 241

(56) References Cited

U.S. PATENT DOCUMENTS

| | | | | | |
|---|---|---|---|---|---|
| 3,746,519 | A | | 7/1973 | Hara et al. | |
| 3,993,446 | A | | 11/1976 | Okawa | |
| 4,466,829 | A | | 8/1984 | Nishigaki et al. | |
| 4,497,660 | A | | 2/1985 | Lindholm | |
| 4,733,715 | A | * | 3/1988 | Matsuzaki et al. | 164/306 |
| 5,305,840 | A | * | 4/1994 | Liang et al. | 175/426 |
| 5,902,942 | A | | 5/1999 | Maderud et al. | |
| 6,027,808 | A | * | 2/2000 | Aoki et al. | 428/408 |
| 6,086,650 | A | | 7/2000 | Carpenter | |
| 6,464,748 | B2 | * | 10/2002 | Perez et al. | 75/240 |
| 6,524,364 | B1 | * | 2/2003 | Ederyd | 75/240 |
| 2002/0059849 | A1 | | 5/2002 | Perez et al. | |

FOREIGN PATENT DOCUMENTS

| | | |
|---|---|---|
| WO | 80/02569 | 11/1980 |
| WO | 92/13112 | 8/1992 |
| WO | 99 13119 A | 3/1999 |

OTHER PUBLICATIONS

European Search Report dated Nov. 2003.

* cited by examiner

*Primary Examiner*—Ngoclan T. Mai
(74) *Attorney, Agent, or Firm*—Burns, Doane, Swecker & Mathis, L.L.P.

(57) ABSTRACT

A cemented carbide with excellent properties for oil and gas applications regarding resistance to the combined erosion and corrosion synergistic effects at temperatures between −50 and 300° C. and toughness. This object has been achieved with a cemented carbide containing, in weight %, 8–12 Co+Ni with a weight ratio Co/Ni of 0.25–4, 1–2 Cr and 0.1–0.3 Mo wherein essentially all of the WC grains have a size <1 $\mu$m and with a magnetic cobalt content between 80 and 90% of that chemically determined.

7 Claims, No Drawings

CEMENTED CARBIDE FOR OIL AND GAS APPLICATIONS WITH TOUGHNESS FACTOR

This application claims priority under 35 U.S.C. §119 to Swedish Application No. 0203157-3 filed in Sweden on Oct. 24, 2002; the entire contents of which is hereby incorporated by reference.

FIELD OF THE INVENTION

The present invention relates to the new use of cemented carbide grade with special properties for oil and gas applications. Moreover the invention refers to the application of a corrosion and erosion-resistant grade including increased toughness characteristics for choke valves to control the flow of multimedia fluid (gas, liquid and sand particles).

BACKGROUND OF THE INVENTION

Cemented carbide used for corrosion resistance in the demanding application of flow control components within the oil and gas sector is subjected to a complex array of service and environmental combinations. Moreover, the cost of "field" failures or unpredictable service life is extremely high.

The opportunity to maintain or replace such equipment in the field, especially in offshore deep-water sites, is limited by weather conditions. It is therefore essential that reliable and predictable products form part of the subsea system.

U.S. Pat. No. 6,086,650 discloses the use of an erosion resistant grade with submicron WC grain size for severe conditions of multi-flow media, where these components suffer from extreme mass loss by exposure to solid particle erosion, acidic corrosion, erosion-corrosion synergy and cavitation mechanisms. Grades according to this patent have, however, turned out to be unable to meet the conflicting demands of hardness (wear) and toughness, especially when the component design features require increased toughness levels.

SUMMARY OF THE INVENTION

It is therefore an object of the present invention to provide cemented carbide with good resistance to particle erosion under corrosion environment and improved toughness compared to prior art materials.

This object has been achieved by using a specifically optimized multi alloy binder sintered with a submicron grain size WC and with a low carbon content.

According to a first aspect, the present invention provides a cemented carbide comprising, in weight %: 8–12% Co+Ni, with a Co/Ni weight ratio of 0.25–4; 1–2% Cr; 0.1–0.3% Mo; wherein essentially all of the WC grains have a size <1 μm, and with a magnetic saturation cobalt content which is 80–90% of the chemically-determined cobalt content.

DETAILED DESCRIPTION

Cemented carbide with excellent properties for oil and gas applications regarding resistance to the combined erosion and corrosion synergistic effects at temperatures between −50 and 300° C., preferably 0–100° C., and toughness, according to the invention has the following composition in weight %: 8–12% Co+Ni with a weight ratio Co/Ni of 0.25–4, 1–2% Cr and 0.1–0.3% Mo. Essentially all of the WC grains have a size <1 μm.

The hardness of the cemented carbide according to the invention shall be >1500 HV30 (IS03878), the toughness ($K_{ic}$)>11 MN/ml$^{1.5}$ and the transverse rupture strength (TRS) according to IS03327>3200 N/mm$^2$.

In one preferred embodiment the cemented carbide has the composition in weight %: 34%, preferably 3.5%, Co, 6–8%, preferably 7%, Ni, 1–1.5%, preferably 1.3%, Cr and 0.2% Mo. Balance is WC with an average grain size of 0.8 μm.

In another embodiment the composition is in weight %: 6–7%, preferably 6.6%, Co, 2–3%, preferably 2.2%, Ni, 1.0% Cr and 0.2% Mo. Balance is WC with an average grain size of 0.8 μm.

The carbon content within the sintered cemented carbide must be kept within a narrow band in order to retain a high resistance to corrosion and wear as well as toughness. The carbon level of the sintered structure is held in the lower portion of the range between free carbon in the microstructure (top limit) and eta-phase initiation (bottom limit). Magnetic saturation measurements for the magnetic binder phase of the sintered cemented carbide is expressed as a % of the maximum expected for that of the pure Cobalt content contained in the carbide. For the sintered material according to the invention this should lie between 80 and 90% of the chemically determined content. No eta-phase is permitted in the sintered structure.

Conventional powder metallurgical methods milling, pressing shaping and sinterhipping manufacture the cemented carbide used in this invention.

The present invention also relates to the use of a cemented carbide according to above particularly for the choke trim components used in the oil and gas industry where components are subjected to high pressures of multi media fluid where there is a corrosive environment, particularly for components, the primary function of which is to control the pressure and flow of well products.

The principles of the present invention will now be further described by reference to the following illustrative non-limiting examples.

EXAMPLE 1

Cemented carbide grades with the following compositions in weight % were produced according to known methods and using WC powder with a grain size of 0.8 μm.

A. WC, 3.5% Co, 7.0% Ni, 1.3% Cr, 0.2% Mo

B. WC, 6.6% Co, 2.2%, Ni, 1.0% Cr and 0.2% Mo

C. WC and 6% Co

D. WC and 6% Ni

E. WC and 12% Co

F. WC and 12% Ni

G. U.S. Pat. No. 6,086,650 Example 1

The materials had the following properties

| Grade | Magnetic cobalt content, weight % | Average WC grain size, μm | Hardness HV30 | Toughness $K_{ic}$ MN/mm$^{1.5}$ | TRS N/mm$^2$ |
|---|---|---|---|---|---|
| A, invention | 2.7 | 0.8 | 1550 | 12 | 3300 |
| B, invention | 5.7 | 0.8 | 1650 | 11.2 | 4600 |
| C | 5.1 | 0.8 | 1700 | 10 | 2600 |
| D | 0 | 0.8 | 1700 | 9 | 2500 |
| E | 10.8 | 0.8 | 1400 | 12 | 3100 |

-continued

| Grade | Magnetic cobalt content, weight % | Average WC grain size, μm | Hardness HV30 | Toughness $K_{ic}$ $MN/mm^{1.5}$ | TRS $N/mm^2$ |
|---|---|---|---|---|---|
| F | 0 | 1.5 | 1400 | 11.5 | 3000 |
| G | 3.0 | 0.8 | 1900 | 9.1 | 2300 |

EXAMPLE 2

The grades A–G were tested under the following simulated test conditions:

Synthetic seawater

Sand 18 m/s $CO_2$ 1 Bar

Temp. 54° C.

The following results were obtained.

Results

| Grade | Corrosion (material loss in mm/year) | Erosion (material loss in mm/year) | Synergistic (material loss in mm/year) | Total (material loss in mm/year) |
|---|---|---|---|---|
| A, invention | 0.01 | 0.05 | 0.05 | 0.11 |
| B, invention | 0.02 | 0.07 | 0.06 | 0.15 |
| C | 0.02 | 0.09 | 0.35 | 0.46 |
| D | 0.015 | 0.265 | 0.17 | 0.45 |
| E | 0.02 | 0.32 | 0.18 | 0.5 |
| F | 0.015 | 0.25 | 0.10 | 0.4 |
| G | 0.015 | 0.06 | 0.025 | 0.10 |

EXAMPLE 3

The grades were also tested under conditions of testing with flow loop containing sea-water and sand at 90 m/s flow rate at two impingement angles, 30 and 90 degrees with respect to the surface of test sample. The following results were obtained.

| Grade | Erosion rate ($mm^3$/kg sand) | Erosion rate ($mm^3$/kg sand) |
|---|---|---|
| Angle | 30 degrees | 90 degrees |
| A, invention | 0.47 | 0.32 |
| B, invention | 0.56 | 0.38 |
| C | 1.8 | 1.4 |
| D | 2.0 | 1.5 |
| E | 1.4 | 1.2 |
| F | 1.5 | 1.3 |
| G | 0.25 | 0.15 |

I claim:

1. A cemented carbide comprising, in weight %:

8–12% Co+Ni, with a Co/Ni weight ratio of 0.25–4;

1–2% Cr;

0.1–0.3% Mo;

wherein essentially all of the WC grains have a size <1 μm, and with a magnetic saturation cobalt content which is 80–90% of the chemically-determined cobalt content.

2. The cemented carbide according to claim 1, further comprising, in weight %:

3–4% Co;

6–8% Ni;

1–1.5% Cr;

0.1% Mo; and balance WC.

3. The cemented carbide according to claim 2, wherein the composition comprises in weight % 3.5% Co, 7% Ni and 1.3% Cr.

4. The cemented carbide according to claim 1, wherein the composition comprises in weight % 6–7% Co and 2–3% Ni.

5. The cemented carbide according to claim 4, wherein the composition comprises in weight % 6.6% Co and 2.2% Ni.

6. A pressure and flow control component comprising, at least in part, the cemented carbide of claim 1.

7. The component of claim 6, wherein the component comprises a choke trim compartment.

* * * * *